US006152441A

United States Patent [19]

Vossen

[11] Patent Number: 6,152,441

[45] Date of Patent: Nov. 28, 2000

[54] METHOD AND APPARATUS FOR MOVING SHEET MATERIAL GRIPPER BARS IN A SHEET-PROCESSING MACHINE

[76] Inventor: Manfred Vossen, Op dem Felde 28, D-41372 Niederkruchten-Elmpt, Germany

[21] Appl. No.: 09/251,790

[22] Filed: Feb. 17, 1999

[30] Foreign Application Priority Data

Feb. 23, 1998 [DE] Germany ..... 198 07 587

[51] Int. Cl.[7] ..... B65H 29/10

[52] U.S. Cl. ..... 271/85; 271/3.17; 414/753

[58] Field of Search ..... 198/470.1, 469.1; 271/204, 85, 84, 4.11, 3.17; 101/408; 414/753

[56] References Cited

U.S. PATENT DOCUMENTS

| | | | |
|---|---|---|---|
| 5,555,969 | 9/1996 | Yerly | 198/803.3 |
| 5,667,211 | 9/1997 | Reist | 270/52.16 |
| 5,669,754 | 9/1997 | Croteau et al. | 414/786 |
| 5,820,335 | 10/1998 | Croteau et al. | 414/788.3 |
| 5,829,576 | 11/1998 | Rodier et al. | 198/803.9 |
| 5,884,747 | 2/1996 | Sandstedt et al. | 198/349.95 |

*Primary Examiner*—Christopher R. Ellis
*Assistant Examiner*—Rashmi Sharma
*Attorney, Agent, or Firm*—Mason, Kolehmainen, Rathburn & Wyss

[57] ABSTRACT

In a method and apparatus for moving gripper bars for the advance of sheet material in a sheet-processing machine with processing stations having upper portions and lower portions, the gripper bars are cyclically advanced in an advance plane which extends between the upper and lower portions of the processing stations. The gripper bars are then returned in the same cycle in the opposite direction to the advance direction in a return plane which is displaced in respect of height with respect to the advance plane. The gripper bars are returned between the upper portions and the lower portions of the processing stations. The advance plane is not connected to the return plane. After termination of the advance movement the gripper bars are set from the advance plane to the return plane and after termination of the return movement they are set from the return plane to the advance plane.

14 Claims, 4 Drawing Sheets

METHOD AND APPARATUS FOR MOVING SHEET MATERIAL GRIPPER BARS IN A SHEET-PROCESSING MACHINE

FIELD OF THE INVENTION

The invention relates to a sheet-processing machine and more specifically to a method and apparatus for moving sheet material gripper bars in a sheet-processing machine.

BACKGROUND OF THE INVENTION

In sheet-processing machines, the individual sheets to be processed are transported intermittently in a cyclic procedure from a feeder which has a device for separating the unprocessed sheets in a stack thereof and for alignedly feeding the sheets to gripper bars of the machine, through various processing stations, such as for example a station for stamping and/or embossing the sheets and a station for breaking off or removing internal waste from the stamped sheets, to a discharge or delivery unit, for example for putting the sheets into a delivery stack. In such an arrangement the processing stations are usually formed from an upper portion and a lower portion, between which the above-mentioned gripper bars pass the sheets. The gripper bars are thus cyclically advanced in an advance plane extending between the upper and lower portions of the respective processing stations, and then, in the same cycle, are returned in the opposite direction to the advance movement, in a return plane which is disposed in displaced relationship in respect of height with respect to the advance plane.

The gripper bars can be fixed to circulating chains and returned to the feeder either above the upper portions of the processing stations, as for example in the arrangement disclosed in DE-OS No 23 24 642, or beneath the lower portions of the processing stations, so that the gripper bars thereby move from the delivery stack back to the feeder.

Such a sheet-processing machine is usually provided with a housing or cowling, for example for safety reasons or for reasons of reducing the amount of noise generated. Provided in the cowling are openings in order to be able to effect set-up and alignment or register operations and in order to be able to observe on-going production. For the setting-up and aligning operations the machine operator must be able to gain access into the machine through the openings in particular in the region of the delivery unit and the waste-breaking-off unit. In that respect most of the operations involved occur above the advance plane of the gripper bars, but to a lesser degree operations are also required below the advance plane. The size of the openings is determined in the advance direction by the spacing of the processing stations or in relation to the delivery unit relative to each other while in the vertical direction the opening size is determined by the spacing between the upper and the lower runs of the above-mentioned gripper bar-carrying chain, relative to the advance plane. The spacing of the processing stations or in relation to the delivery unit with respect to each other corresponds to the spacing of the gripper bars from each other, which is to be kept at a minimum for reasons relating to the dynamics of the machine. The consequence of this is that, in the case of machines for dealing with smaller sheet formats, smaller than about 1 m×0.7 m, the openings in the machine cowling become so small that the machine operator can no longer bend therethrough and therefore can no longer implement the necessary operations within the machine. Furthermore, if the gripper bars are returned above the upper portions of the processing station, the upper tool arrangement in the processing stations, for example an upper stamping head, is limited in respect of height as it has to be arranged between the circulating chains. That results in severe limitations in regard to the choice of the operating principle for the stamping head.

The same also applies in regard to the lower tool arrangement such as a stamping head if the gripper bars are returned beneath the lower portions of the processing stations. A further disadvantage in this respect is that the height of the finished stack of sheets is severely limited. It is however an aspect of great importance that stacks of cut sheets constituting blanks for example for making articles should be of relatively great height, for reasons of economy of further processing. If small stacks have to be assembled to constitute higher stacks, further items of equipment are specifically required for that purpose, and that means that the cost, amount of space required and operating time involved are increased. As the chains pass around the delivery stack and the stacks have to be removed in a non-stop mode of operation, that is to say while the machine continues to run, the delivery stacks can only be removed from the machine laterally. The need for space at which the finished stacks are set down, or connections between the sheet-processing machine and subsequent machines, can require the finished stacks to be removed in the direction in which the sheets are advanced through the sheet-processing machine. Furthermore, the fact that the chains circulate below the advance plane of the sheets being processed in the machine means that disposing of waste in the breaking-off unit and in the delivery unit cannot be effected directly, that is to say through openings in the bottom of the arrangement, into a container or a truck.

SUMMARY OF THE INVENTION

An object of the present invention is to provide an improved method of moving gripper bars for the advance of sheet material in a sheet-processing machine, which permits the machine to operate in a faster and more rational manner.

Another object of the present invention is to provide a method of moving gripper bars for advancing sheet material in a sheet-processing machine, whereby the sheets can be reliably moved through the machine in an on-going procedure without operation of the machine being impeded by the gripper bars.

Still another object of the present invention is to provide an apparatus for the movement of gripper bars in a sheet-processing machine, which can be of a simple but reliable structure to provide for the required operating procedure for the gripper bars.

In accordance with the principles of the present invention in the method aspect the foregoing and other objects are attained by a method of moving gripper bars for the advance of sheet material in a sheet-processing machine with processing stations each having an upper portion and a lower portion, in which the gripper bars are cyclically advanced in an advance level or plane which extends between the upper and lower portions of the processing stations, and ther in the same cycle the gripper bars are returned in the opposite direction to the advance direction, in a return plane or level which is displaced in terms of height with respect to the advance plane. The gripper bars are returned between the upper portions and the lower portions of the processing station. The advance plane is not connected to the return plane. After termination of the advance movement thereof the gripper bars are moved from the advance plane to the return plane while after termination of the return movement thereof the gripper bars are moved from the return plane to the advance plane.

In regard to the apparatus aspect, in accordance with the present invention the foregoing and other objects are attained by an apparatus for carrying out the method of the invention, wherein the sheet-processing machine has a feeder means for the feed of sheet material to be processed, processing stations each having an upper portion and a lower portion, and a delivery means for the processed sheet material, the feeder means, processing stations and delivery means being arranged in succession at at least substantially equal spacings from each other. In each of the advance plane and the return plane, the apparatus has at least one respective advance bar which extends in the direction of movement of the gripper bars and which can be releasably brought into engagement with the gripper bars. For that purpose the advance bar has receiving devices which are arranged at the spacing of the processing station and the number of which is greater by one than the number of processing stations. The apparatus further includes drive means for cyclically reciprocating the advance bars synchronously in mutually opposite relationship between an end position in the proximity of the feeder means and an end position in the proximity of the delivery means, by a distance corresponding to the spacing of the processing stations. The at least one advance bar in the advance plane during the movement towards the delivery means and the at least one advance bar in the return plane during the movement towards the feeder means are in engagement with the gripper bars, while they are out of engagement with the gripper bars during the respective movement in the other direction. In the end position regions of the advance bars, the apparatus has height-displacement means for effecting heightwise displacement of the gripper bars between the advance plane and the return plane.

As will become apparent from a descriptior hereinafter of a preferred embodiment of the invention, the features in accordance with the invention facilitate access to the operating components of the machine as components involved in the transportation movement of the gripper bars are not to be found either above the upper portions of the processing stations or below the lower portions thereof. That means that it is also possible for the components for the stamping head to be of the optimum design configuration or dimensioning, in accordance with the demands involved. The delivery stack of sheets is freely accessible and can be removed from the machine selectively laterally or also in a downstream direction, that is to say in the direction in which the sheet material is advanced through the machine. The waste which is produced in the breaking-off unit and in the delivery unit can be readily disposed of, in a downward direction.

Because the gripper bars are no longer forced to move at high speed through the tight radii of deflection means for changing the directions in which chains extend, as in the case of the conventional machine referred to hereinbefore, and as therefore no centrifugal forces act on the gripper bars transversely to the transport direction, the height of the gripper bars can be shallower than in the case of gripper bars for a conventional machine. The gripper bars can be of such a shallow configuration that the overall dimension of the two gripper bars which are transported one over the other does not exceed the heightwise dimension of the gripper bars of a conventional machine. That can ensure that, when the gripper bars are moving in opposite relationship through the processing tools in the open condition in the processing stations, they do not suffer from any disadvantages or detriment in regard to the conditions relating to the stroke movements performed at the processing stations.

Advantageously, the gripper bars are moved from the advance plane to the return plane and from the return plane to the advance plane, by a translatory movement. That further reduces the level of machine expenditure and also the amount of space that the machine requires as there is no need to provide a device for rotating or turning the gripper bars, nor is there is any need to provide a free space for such movement.

In accordance with a preferred feature of the invention the advance plane and the return plane extend in mutually parallel relationship. It is also desirable for the gripper bars to be movable linearly. Those features contribute to further reducing the level of machine expenditure and the amount of space required.

In a preferred feature of the invention the gripper bars extend transversely with respect to their direction of movement and arranged in each of the advance plane and the return plane are respective pairs of advance bars which extend at a spacing in mutually parallel relationship and which have mutually facing receiving means which can be brought into engagement with the end regions of the gripper bars. That increases the level of accuracy with which the gripper bars can be guided and positioned.

Preferably, the receiving means of the advance bars disposed in the advance plane and the receiving means of the advance bars disposed in the return plane are respectively arranged in mutually displaced relationship in the longitudinal direction of the advance bars. That displaced relationship is necessary so as to provide space for the required tool frame structures in the respective processing stations, such as for example in the stamping unit, the breaking-off unit or the delivery unit.

Preferably, the above-mentioned receiving means are in the form of openings or recesses.

A preferred embodiment of the invention has arresting means which arrest the gripping bars when they are out of engagement with the advance bars. In that respect, the arresting means preferably arrest the gripping bars in the processing stations and in a particularly preferred configuration the arresting means have indexing means such as index pins around which the gripper bars are tiltable by a predetermined amount. Those structural features provide that the gripper bars are fixed in respect of position relative to the processing stations when they are out of engagement with the advance bars and the latter are moved in an empty or idle condition between the gripper bars. Without that fixing effect, the gripper bars would not enjoy a properly defined position, and that would result in inaccurate and imprecise processing in the processing stations.

In a further preferred embodiment of the invention the advance bars are mounted tiltably or pivotably about longitudinal axes thereof, and connection and release of the gripper bars to or from the advance bars is effected by tilting or pivotal movement of the gripper bars. In that way, the gripper bars are brought into or out of engagement with the advance bars in a simple operating procedure.

In a preferred feature in this respect, in cross-section the advance bars have a propeller profile with first and second mutually oppositely disposed individual blades, and the openings for receiving the end portions of the gripper bars are provided in the blades disposed on the one side of the gripper bars, while provided in the blades disposed on the other side is at least one respective opening for engaging a drive element for the longitudinal movement of the advance bars.

Further objects, features and advantages of the invention will be apparent from the following description of a preferred embodiment thereof.

DESCRIPTION OF THE PREFERRED EMBODIMENT

Figure 1:
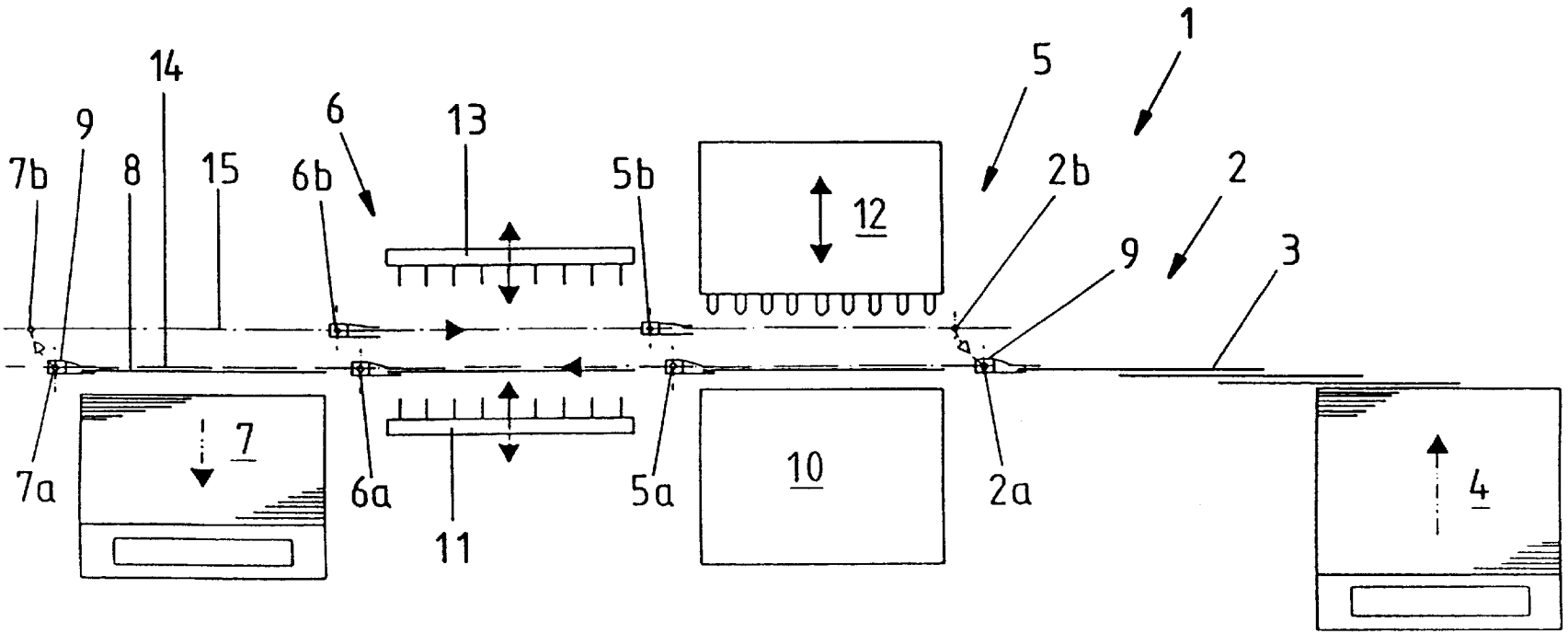
FIG. 1 is a diagrammatic side view of an apparatus according to the invention.

Referring firstly to FIG. 1, shown therein by way of example is a sheet-processing machine which is generally identified by reference numeral 1 and which includes a feeder 2 for feeding the sheet material 3 to be processed, in the form of sheets which have been separated from an unprocessed sheet stack 4, first and second processing stations, more specifically a stamping station 5 and a breaking-off station 6, and a delivery unit 7 for the processed sheet material as indicated at 8. The feeder 2, the processing stations 5, 6 and the delivery unit 7 are arranged in succession in the axial direction of the machine at spacings such that associated stopping points indicated at 2*a*, 5*a*, 6*a*, 7*a*, 2*b*, 5*b*, 6*b* and 7*b* for gripper bars 9 are at the same spacings relative to each other. The stamping station 5 and the station 6 each have a lower portion 10, 11 and an upper portion 12, 13 which are in part movable upwardly and downwardly and between which the sheet material 3 passes therethrough.

For transportation of the sheet material 3 through the machine, the arrangement uses gripper bars 9 which in the illustrated embodiment extend transversely to the direction of transportation movement, which engage the unprocessed sheet material 3 in the feeder 2, and which advance it cyclically in a feed plane or level 14 to the processing station 5, then the processing station 6 and then to the delivery unit 7. After a gripper bar 9 has set down the processed sheet material 8 in the delivery unit 7, the gripper bar 9 is then lifted to a return plane or level diagrammatically indicated at 15, which extends above the advance plane or level 14 and also between the lower portions 10, 11 and the upper portions 12, 13 of the processing stations 5, 6, whereby the gripper bar 9 is returned in the return plane 15 in the same cycle back to the feeder 2 where it is moved downwardly from the return plane 15 to the advance plane 14 and in so doing again engages a sheet 3 in the feeder 2.

Figure 2:
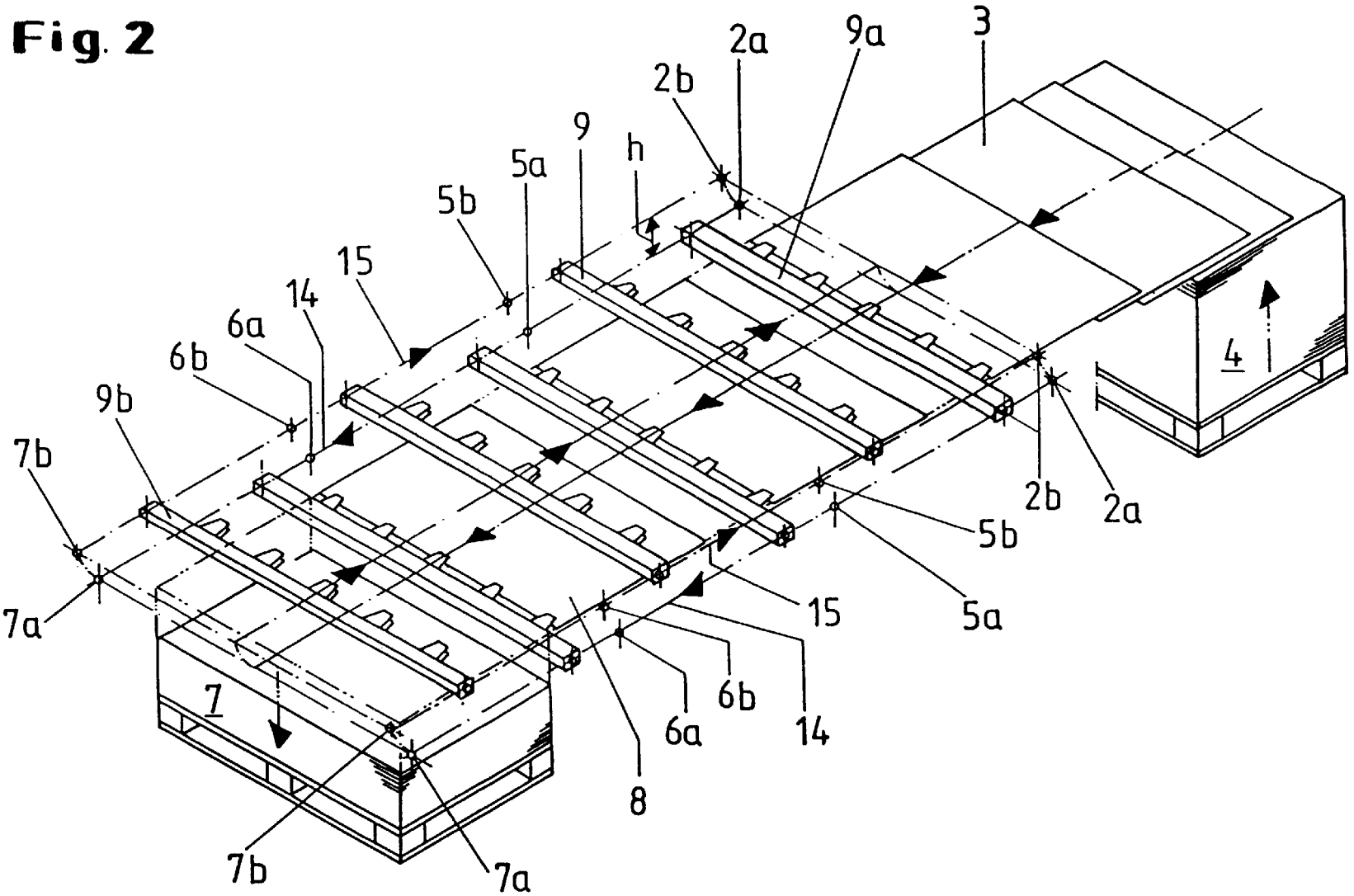
FIG. 2 is a diagrammatic perspective view of the apparatus structure shown in FIG. 1, with the two central processing stations being omitted and illustrating the arrangement of the gripper bars in the advance plane and in the return plane.

Reference is now made to FIG. 2 showing the sequence of movements of the gripper bars 9 in the machine 1. For the sake of clarity of the drawing, FIG. 2 does not show the processing stations 5, 6 and the corresponding distances by which the gripper bars 9 are cyclically advanced and returned are marked by the associated stopping points 2*a*, 5*a*, 6*a*, 7*a*, 2*b*, 5*b*, 6*b* and 7*b*. A gripper bar 9*a* which is disposed in the advance plane 14 has engaged a sheet 3 in the feeder 2 in a first cycle, and is moving towards the first processing station 5. The two gripper bars 9 which have stopped in the two processing stations 5, 6 are advanced each with a respective sheet to the next processing station 6 or to the delivery unit 7. The gripper bar 9*b* which is in the proximity of the delivery unit 7 has already set down its finished processed sheet 8 in the delivery unit 7 and has been raised from the advance plane 14 up to the return plane 15. The return plane 15 already contains two further gripper bars 9 which are moving back towards the feeder 2, more specifically, a gripper bar which is just downstream of the stopping point 6*b* for the second processing station 6 and a gripper bar which is just downstream of the stopping point 5*b* for the first processing station 5. In the next cycle, the gripper bars 9 are respectively advanced to the next stopping point, that is to say the gripper bar 9*a* which for example in the first cycle was advanced from the feeder 2 to the first processing station 5 is in the second cycle advanced to the second processing station 6, and so forth.

The advance plane 14 and the return plane 15 are not connected to each other, that is to say they do not communicate with each other, and they extend over their entire length in parallel relationship, wherein the return plane 15 is displaced in respect of height with respect to the advance plane 14 and, in the illustrated embodiment, is a distance indicated at h above the advance plane 14. The gripper bars 9 are moved linearly from the feeder 2 to the delivery unit 7, and also linearly back from the delivery unit 7 to the feeder 2.

Figure 3:
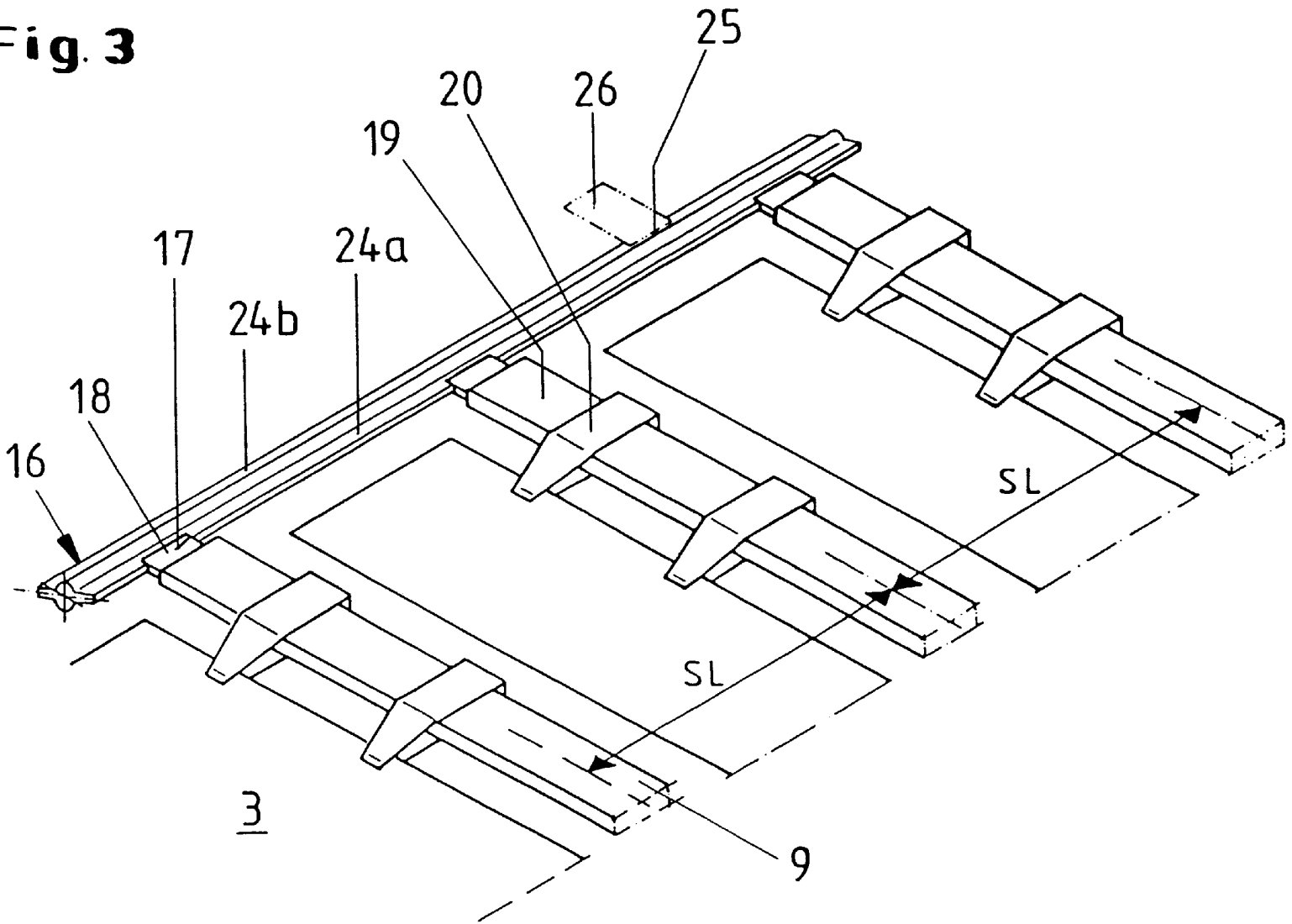
FIG. 3 is a diagrammatic perspective view of a connection between gripper bars and advance bars.

As can be seen now from FIG. 3, conveyor or advance bars 16 of a comb-shaped structure are provided for the advance and return movements of the gripper bars 9. The advance bars 16 extend in the direction of movement of the gripper bars 9. Arranged in each of the advance plane 14 and the return plane 15 are a respective pair of advance bars 16 which extend at a spacing in mutually parallel relationship and which have mutually facing receiving means which, in the illustrated embodiment, are in the form of openings or recesses 17. The gripper bars 9 extend transversely with respect to their direction of movement or with respect to the advance direction of the sheet material 3, 8, and, with their end portions 18, can engage into the openings 17 in the advance bars 16. It will be noted in this respect that FIG. 3 does not show the second end region of the gripper bars 9 and the second advance bar in the respective plane in question. The openings 17 in each advance bar 16 are arranged at a distance from each other corresponding to the spacing of the processing stations, while there is one opening 17 more than the number of processing stations 5, 6. In the illustrated embodiment the advance bars 16 respectively engage three gripper bars 9 simultaneously. While the advance bars 16 of the advance plane 14 are transporting three gripper bars 9 in the direction towards the delivery unit 7 over a distance corresponding to a system length as indicated at SL in FIG. 3 or over a distance corresponding to the spacing between two adjacent processing stations, the advance bars 16 in the return plane 15 are transporting three gripper bars 9 in a direction towards the feeder 2.

Referring still to FIG. 3 each of the gripper bars 9 has a carrier indicated at 19 which extends transversely to the advance direction or transversely with respect to the advance bars 16 and on which are mounted a plurality of grippers 20 which are arranged at suitable spacings relative to each other, for engaging the sheet material 3, 8. The height of the gripper bars 9 is less than half the height of the gripper bars used in the above-discussed conventional sheet-processing machines so that the total height of the gripper bars 9, which are arranged one above the other, in the advance plane 14 and in the return plane 15, is no greater than the height of the gripper bars used in the conventional sheet-processing machine, and therefore no problems arise in regard to the stroke movement heights of the processing stations.

Figure 4:
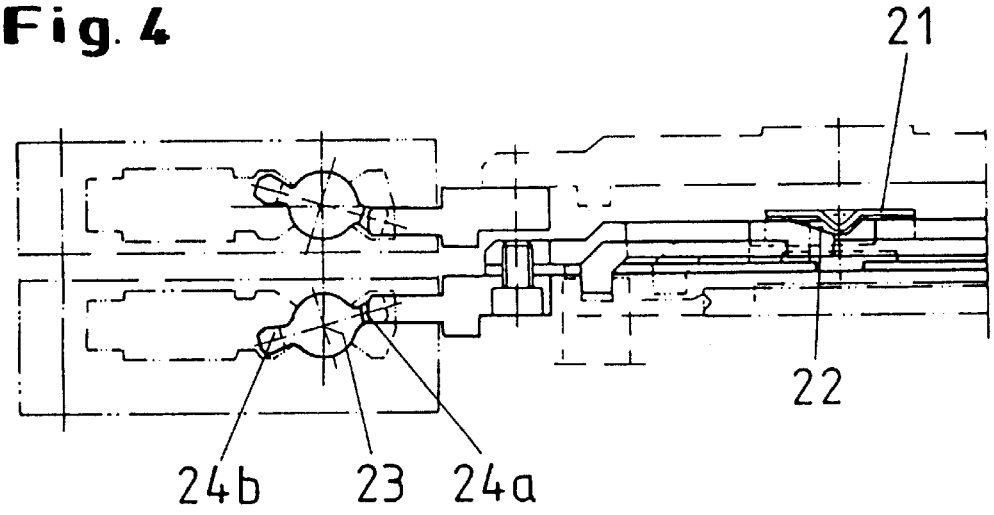
FIG. 4 is a diagrammatic cross-sectional view transversely with respect to the direction of advance movement, through the advance plane and the return plane.

Referring to FIG. 4, it will be seen therefrom that the grippers 20 each have a leaf spring 21 which can be lifted by a thrust rod 22 in order to move the gripper 20 into an open position, being the position shown in dash-dotted line in FIG. 4.

When they pass into the delivery unit 7, the grippers 20 of the respective gripper bar 9 are centrally opened by for example a run-on cam (not shown). In that way, when the gripper bar 9*b* disposed in the delivery unit 7 is raised to the return plane 15 and in the resulting movement in a direction towards the last processing station which in the illustrated embodiment is the second processing station 6, the sheet 8 can be stripped out of the open grippers 20 by stripping-out devices (not shown).

In the return plane 15, the gripper bars 9 are moved back to the feeder 2, with the grippers 20 in the open condition, so that when the gripper bars are moved downwardly from the return plane 15 into the advance plane 14, the open grippers 20 embrace the front edges of the sheets 3 which are disposed in the feeder 2 and which have already been suitably aligned and oriented. That mode of operation means that the operating procedure of the sheet feeder, in respect of time, can be made more effective. Then, the grippers 20 are centrally closed by a suitable control device, with the sheets 3 being engaged in the correct positional relationship by the gripper bars 9.

The mechanism with which the advance bars 16 and the gripper bars 9 are brought into engagement with each other for a transportation stroke movement or are brought out of engagement with each other for an idle stroke movement in the other direction, is shown in FIG. 4. The advance bars 16 are mounted tiltably or pivotably about their longitudinal axes 23 and are brought into or out of engagement with the gripper bars 9, by the advance bars 16 being tilted or pivoted between a first position in which they are in engagement with the gripper bars 9 and a second position in which they are out of engagement with the gripper bars 9. The advance bars 16 have first and second mutually oppositely disposed individual blades 24*a*, 24*b* of a configuration similar to a propeller, with one blade 24*a* facing towards the gripper bars 9, as can be clearly seen from FIG. 3. That blade 24*a* has the openings 17 for receiving the end portions 18 of the gripper bars 9. The blade 24*b* on the other opposite side has at least one opening 25 into which can engage a drive element indicated at 26 in FIG. 3, of a drive device (not shown), for driving the advance bars 16 in a reciprocating movement along the longitudinal axis thereof. The drive device can be in the form of a double-cam drive means, while chains, toothed belts, steel bands, toothed racks and the like can be suitably used as the transmission means from the drive assembly to the advance bars 16.

Figure 5:
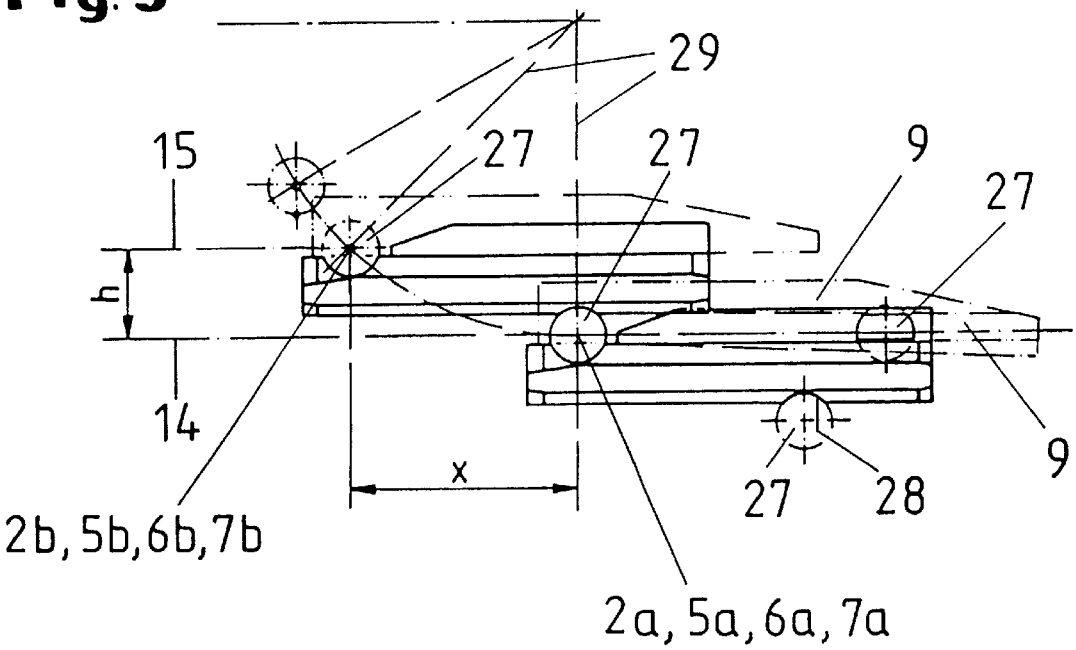
FIG. 5 is a diagrammatic view of gripper bars in an arrested condition.

Reference is now made to FIG. 5 showing the arrangement of a gripper bar 9 in the advance plane 14, disposed in a processing station, in relation to an adjacent gripper bar 9 in the return plane 15. As can also be seen from FIG. 2. the stopping points 2*b*, 5*b*, 6*b*, 7*b* of the gripper bars 9 in the return plane 15 are displaced by the distance x in the direction of the delivery unit 7, in relation to the stopping points 2*a*, 5*a*, 6*a*, 7*a* of the gripper bars 9 in the advance plane 14. That displacement x is necessary in order to provide space for the required tool frame structures both in the processing stations 5, 6 and in the delivery unit 7. If the advance bars 16 and the gripper bars 9 are not in engagement with each other, the gripper bars 9 are fixed in location by indexing means such as index pins 27 in order to maintain a defined position during the processing operation, in particular in relation to the processing stations. The arrangement may have index pins 27 which arrest either only the gripper bar 9 in the advance plane 14 or only the gripper bar 9 in the return plane 15. The gripper bars 9 have suitable openings or recesses 28 for the index pins 27. It is however also possible for an index pin 27 to be pushed between the upper and lower gripper bars 9, thereby to fix both of them in position simultaneously. It is only when the gripper bars 9 are arrested by the index pins 27 that the gripper bars 9 are uncoupled from the advance bars 16 and then the advance bars 16 perform an idle stroke movement over a distance corresponding to a system length SL or over a distance between the processing stations in the direction of the feeder 2 in the case of the advance plane 14 and in the direction of the delivery unit 7 in the case of the return plane 15.

At the beginning of the idle stroke movement the gripper bar 9*b* which is in the delivery unit 7 is moved once again by the distance x in the advance direction by a pivoting advance device 29 (only indicated in FIG. 5), and in that situation is lifted by a distance indicated at h to the return plane 15, while the gripper bar 9 which is at the feeder 2 is moved back again by the distance x by a second pivoting advance device and in that case is lowered at the same time by the distance h to the advance plane 14.

In the processing stations, that is to say in the stamping unit 5 and the unit 6 in the illustrated embodiment, and also in the delivery unit 7, the gripper bars 9 are slightly tilted by pivoting devices (not shown, about the index pins 27 which thus serve as pivot axes, by a predetermined amount, against the force of resilient rail portions, so that the grippers 20 are lowered to the processing level. After processing of the sheet material has been suitably implemented, that procedure is reversed again.

It will be seen therefore that the above-described method and apparatus according to the invention provide a simple operating procedure and apparatus structure, for example with the gripper bars being moved with a translatory movement between the advance plane and the return plane, and being movable through the processing stations with a linear movement. The gripper bars are moved by the advance bars in synchronous relationship in the cyclic operating procedure from one end of the sheet-processing machine to the other.

It will be appreciated that the above-described method and apparatus according to the invention have been set forth merely by way of example and illustration of the principles thereof and that various other modifications and alterations may be made therein without thereby departing from the spirit and scope of the invention.

What is claimed is:

1. A method of moving gripper bars for the advance of sheet material in a sheet-processing machine with processing stations each having an upper portion and a lower portion, in which the gripper bars are cyclically advanced in an advance plane which extends between the upper and lower portions of the processing stations, in the same cycle the gripper bars are then returned in the opposite direction to the advance direction in a return plane which is displaced in respect of height with respect to the advance plane, the gripper bars being returned between the upper portions and the lower portions of the processing stations, wherein the advance plane is not connected to the return plane, and after termination of the advance movement the gripper bars are set from the advance plane to the return plane and after termination of the return movement the gripper bars are set from the return plane to the advance plane.

2. A method as set forth in claim 1 wherein the gripper bars are set with a translatory movement from the advance plane to the return plane and from the return plane to the advance plane.

3. A method as set forth in claim 1 wherein the advance plane and the return plane are arranged in mutually parallel relationship.

4. A method as set forth in claim 1 wherein the gripper bars are moved linearly.

5. Apparatus for moving gripper bars for the advance of sheet material in a sheet-processing machine wherein the sheet-processing machine has a feeder means for the feed of the sheet material to be processed, processing stations each having an upper portion and a lower portion, a delivery means for the processed sheet material, the feeder means, processing stations and delivery means being arranged in succession at spacings from each other, and said gripper bars for the advance of sheet material through the processing stations, wherein the gripper bars are cyclically advanceable in an advance plane which extends between the upper and lower portions of the processing stations and in the same cycle are then returnable in the opposite direction to the advance direction in a return plane which is displaced in respect of height with respect to the advance plane and is between the upper portions and the lower portions of the processing stations, comprising in each of the advance plane and the return plane at least one respective advance bar which extends in the direction of movement of the gripper bars and which is operable to be releasably brought into engagement with the gripper bars and for that purpose has receiving devices which are arranged at the spacing of the processing stations and the number of which is greater by one than the number of processing stations, drive means operable to cyclically reciprocate the advance bars synchronously in mutually opposite relationship between an end position in the proximity of the feeder means and an end position in the proximity of the delivery means by the spacing of the processing stations, wherein the at least one advance bar of the advance plane during the movement towards the delivery means and the at least one advance bar of the return plane during the movement towards the feeder means are in engagement with the gripper bars and are out of engagement with same during the movement in the respective other direction, and height-displacement means in the end position regions of the advance bars for effecting heightwise displacement of the gripper bars between the advance plane and the return plane.

6. Apparatus as set forth in claim 5 wherein said spacings of said feeder means, said processing stations and said delivery means are at least substantially equal.

7. Apparatus as set forth in claim 5 wherein the gripper bars extend transversely with respect to their direction of movement and have end portions, and further including in each of the advance plane and the return plane first and second respective advance bars which extend at a spacing in mutually parallel relationship and have mutually facing receiving means engageable with the end portions of the gripper bars.

8. Apparatus as set forth in claim 7 wherein the receiving means of the advance bars in the advance plane and the receiving means of the advance bars in the return plane are respectively arranged in mutually displaced relationship in the longitudinal direction of the advance bars.

9. Apparatus as set forth in claim 7 wherein the receiving means are in the form of openings.

10. Apparatus as set forth in claim 5 including arresting means for arresting the gripper bars when they are out of engagement with the advance bars.

11. Apparatus as set forth in claim 10 wherein the arresting means have index pins around which the gripper bars are tiltable by a predetermined amount.

12. Apparatus as set forth in claim 5 wherein the advance bars have longitudinal axes and further including means for mounting the advance bars pivotably about their longitudinal axes, connection and release of the gripper bars with respect to the advance bars being effected by pivotal movement of the advance bars.

13. Apparatus as set forth in claim 9 and including a drive element for the longitudinal movement of the advance bars, wherein as viewed in cross-section the advance bars have a propeller profile with first and second mutually oppositely disposed individual blades and the openings for receiving the end portions of the gripper bars are provided in the blades disposed on the one side of the advance bars and including in the respective blades arranged on the other side at least one opening for engaging said drive element.

14. A machine for processing sheet material comprising a feeder means for a feed of sheet material to be processed, processing stations having an upper portion and a lower portion, a delivery means for the processed sheet material, wherein the feeder means, the processing stations and the delivery means are arranged in succession at spacings from each other, gripper bars for the advance of sheet material from the feeder means through the processing stations to the delivery means, the gripper bars being cyclically advanceable in an advance plane which extends between the upper and lower portions of the processing stations and in the same operating cycle then being returnable in the opposite direction to the advance direction in a return plane which is displaced in respect of height with respect to the advance plane and is between the upper portions and the lower portions of the processing stations, in each of the advance plane and the return plane at least one respective advance bar which extends in the direction of movement of the gripper bars and which is operable to be releasably brought into engagement with the gripper bars and for that purpose has receiving devices which are arranged at the spacing of the processing stations and the number of which is greater by one than the number of processing stations, drive means operable to cyclically reciprocate the advance bars synchronously in mutually opposite relationship between an end position in the proximity of the feeder means and an end position in the proximity of the delivery means by the spacing of the processing stations, wherein the at least one advance bar of the advance plane during the movement towards the delivery means and the at least one advance bar of the return plane during the movement towards the feeder means are in engagement with the gripper bars and are out of engagement with same during the movement in the respective other direction, and height-displacement means in the end position regions of the advance bars for effecting heightwise displacement of the gripper bars between the advance plane and the return plane.

* * * * *